US006665985B1

(12) United States Patent
Hennes

(10) Patent No.: US 6,665,985 B1
(45) Date of Patent: Dec. 23, 2003

(54) VIRTUAL REALITY THEATER

(75) Inventor: Thomas Hennes, New York, NY (US)

(73) Assignee: Thinc, New York, NY (US)

( * ) Notice: Subject to any disclaimer, the term of this patent is extended or adjusted under 35 U.S.C. 154(b) by 0 days.

(21) Appl. No.: 09/392,960

(22) Filed: Sep. 9, 1999

(51) Int. Cl.[7] ..... E04H 3/26

(52) U.S. Cl. ..... 52/7; 52/29; 352/69; 359/451; 472/60; 472/61

(58) Field of Search ..... 52/6, 8, 9, 7, 29; 472/59, 60, 61, 130; 352/69; 359/443, 451

(56) References Cited

U.S. PATENT DOCUMENTS 5,611,174 A * 3/1997 Hayashi ..... 52/8
5,765,314 A * 6/1998 Giglio et al. ..... 52/7
5,845,434 A * 12/1998 Hayashi ..... 52/9
6,280,341 B1 * 8/2001 Hayashi ..... 472/61
6,407,798 B2 * 6/2002 Graves et al. ..... 352/69

* cited by examiner

*Primary Examiner*—Carl D. Friedman
*Assistant Examiner*—Yvonne M. Horton
(74) *Attorney, Agent, or Firm*—Coudert Brothers LLP

(57) ABSTRACT

An interactive theater for creating a perception on the part of the audience that they are immersed in a boundless environment. The projection surface surrounds the audience platform and the ceiling to form a cavity providing a full or apparent 360° projected environment horizontally and apparent 360° projected environment vertically.

23 Claims, 7 Drawing Sheets

VIRTUAL REALITY THEATER

FIELD OF THE INVENTION

The present invention is in the field of theater design and is specifically related to an interactive theater which provides an audience with the experience of being totally immersed in a desired environment

BACKGROUND OF THE INVENTION

Several prior art theater designs provide audiences with simulated immersion environments. Such prior art theaters include planetariums having hemispherical screens which are used to create the illusion of a sky, and very large screen theaters which create particularly large images, for example, theaters operated under the "OMNIMAX" trademark. In such theaters, images are projected onto projection surfaces or screens. Such images may be created using projectors which pass light through conventional "film" or, more recently, may be digitally generated. In some instances, specialized projectors are used, such as the hemispherical projectors used in planetariums. In addition, modern amusement park "rides" have used projected images to create a virtual reality experience, coordinating the movements of the ride with a projected image to create the illusion of being immersed in a created environment. However, heretofore theater designs have not provided audiences with a total immersion, active experience.

SUMMARY AND OBJECTS OF THE INVENTION

In its preferred embodiment, the present invention provides a virtual reality theater design which gives the audience a total immersion experience. The theater design of the present invention includes a building structure housing an audience platform, a ceiling, a large projection surface, preferably cylindrical or spherical, surrounding such audience platform and ceiling, an optical projection system, a sound system producing sound effects in multiple directions, and a computer-controlled show system for controlling the optical projection system and the sound system. The theater of the present invention may additionally include a plurality of detectors or sensors for detecting audience movements or actions in order to vary the projected image in response to such detected movement or action. That is, in a preferred embodiment, the present invention dynamically varies the events of the simulated environment or the images to be displayed to create and modify the simulated environment in response to audience movements or actions.

Therefore, it is an object of the present invention to provide a theater which provides an audience with the experience of being totally immersed in a desired environment.

Also, it is an object of the present invention to provide a theater which immerses an audience in a full or apparent 360° projected environment horizontally and apparent 360° projected environment vertically.

Another object of the present invention is to provide an interactive virtual reality theater assembly having an optical projection system and a control system that detects audience motions and/or sounds and projects images in response to such detection to dynamically alter the simulated environment.

Further object of the present invention is to provide a computer control system to control the display of images (or programs containing the images) that is used to create a desired simulated environment in accordance with the audience movements, actions, sounds or the like.

Still another object of the present invention is to provide a lighting device to generate light effects in accordance with the projected images to create a desired simulated environment.

Yet another object of the present invention is to provide a multi-channel sound system to generate sound effects in accordance with the projected images to create a desired simulated environment.

Still another object of the present invention is to provide a movable ceiling which may be detached, lifted or angled to convert the theater of the present invention into a conventional film or video theater or lecture hall.

Various other objects, advantages and features of the present invention will become apparent from the ensuing detailed description.

DETAILED DESCRIPTION

Figure 1:
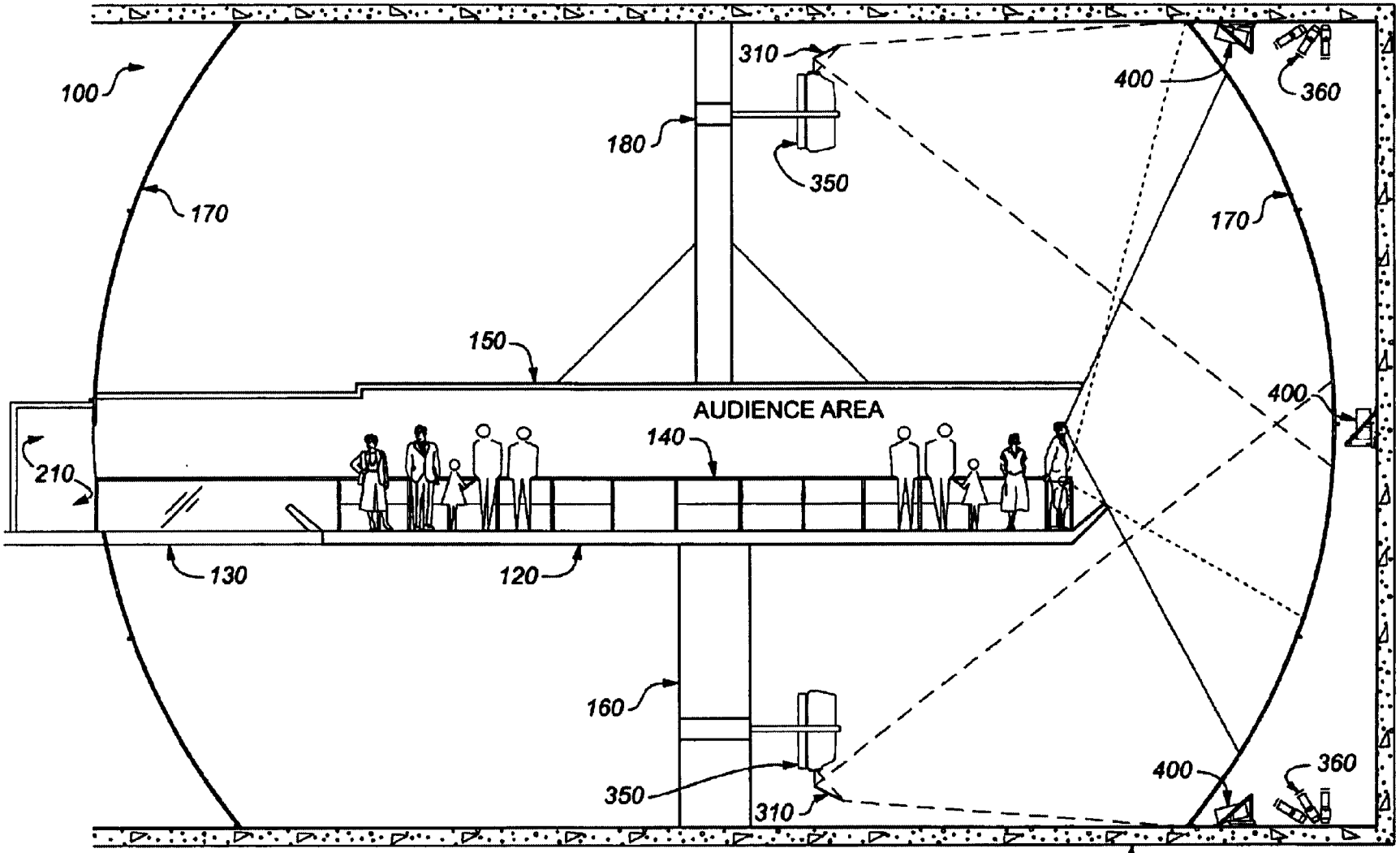
FIG. 1 is a sectional view of an embodiment of the theater assembly of the present invention.

As shown in FIG. 1, a theater assembly 100 of the present invention includes a building structure 105 housing a ceiling 150, an audience platform 120, a projection surface or screen 170 surrounding the audience platform 120 and the ceiling 150 to form a cavity, preferably spherical in shape and an optical projection system comprising projectors 350 and mirrors 310. Alternatively, the projection surface 170 may be cylindrical and disposed about a vertical central axis which passes through the audience platform 120. The projection surface 170 may consist of stretch-formed aluminum panels mounted to an exterior framework such that the panels appear to be one compound-curved continuous surface. Alternatively, the projection surface 170 may comprise a flexible projection screen. The projection surface 170 is preferably mounted to an exterior framework in such a manner that the mounting is not visible to the audience.

If the projection screen 170 is cylindrical, it is preferably bounded by compound-curved coves, such as tordial coves, constructed of stretch-formed aluminum panels. The aluminum panels are mounted in a manner such that the juncture of the coves and the cylindrical projection screen are not visible to the audience. Preferably, the projection surface 170 is perforated to allow the transmission of sound from the sound system 400 and optical effects from the special effects device 360 which originate outside the spherical structure and the audience area. Also, it is appreciated that the extreme top and bottom portions of the projection surface 170 are not visible to the audience from any position on the audience platform 120.

It is appreciated that the projection surface 170 may consist of any combination of compound- or simple-curved surfaces. Preferably, the edges of the individual aluminum panels and the edges of the projection surface as a whole are not visible to the audience from any position on the audience platform 120.

It is also appreciated that the projection surface 170 may be truncated at the top and bottom due to the vertical space constraints imposed by the building structure 100 or the like. In such a case, the edges of the projection surface 170 should either be out of the audience line-of-sight because of the ceiling 150 or covered by a compound-curved cove in which the edge of the cove nearest to the audience is not readily apparent to the audience and the edge farthest from the audience is out of the audience line-of-sight.

Figure 2:
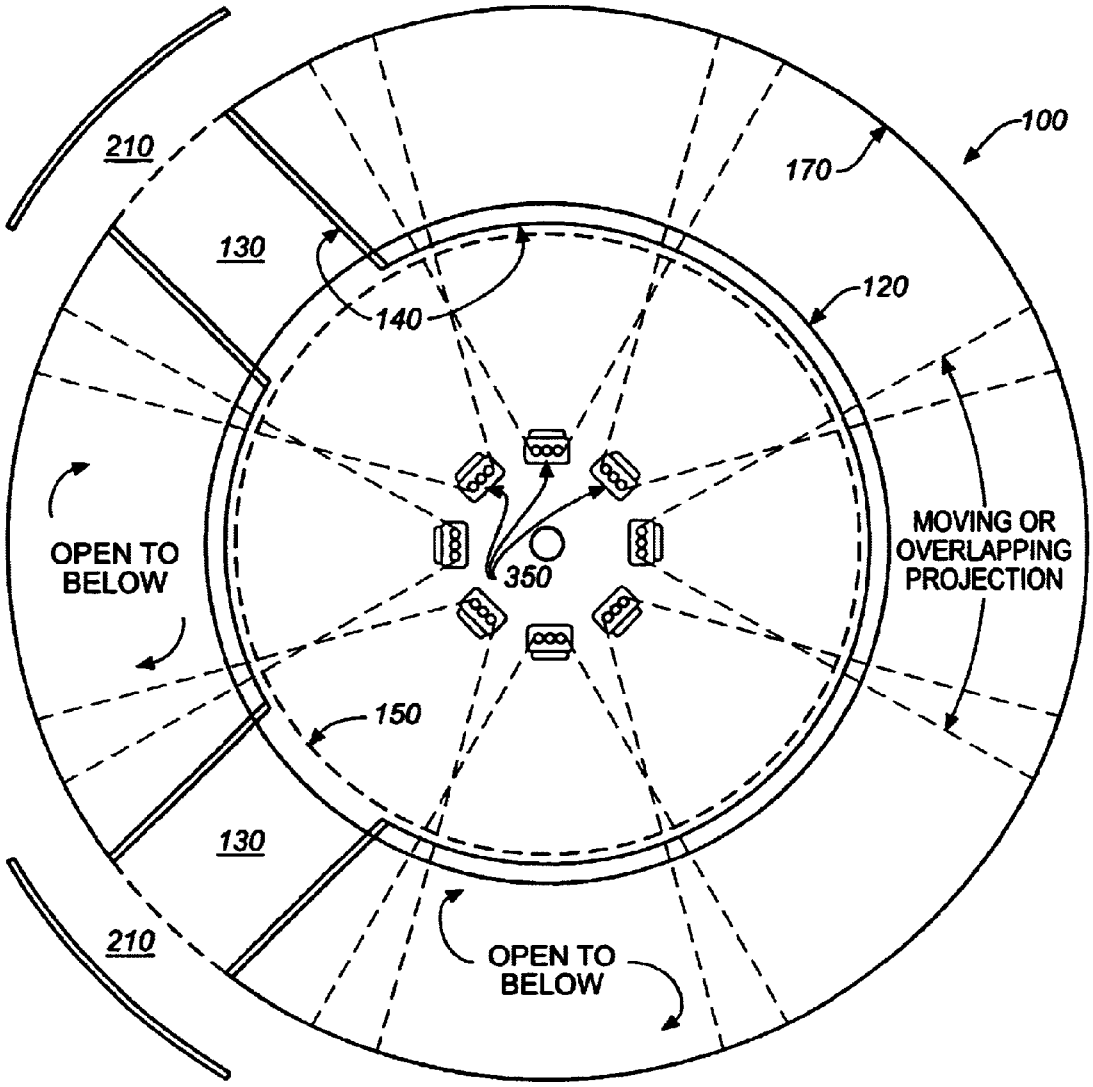
FIG. 2 is a plan view of the theater assembly of the present invention with two egresses.

The audience platform 120 preferably includes at least one bridge structure 130 and railings 140. The audience platform 120 is mounted on a central post or structure 160 such that projection equipment mounted below is not obscured by the supporting post 160. As shown in FIG. 2, in the preferred embodiment, the audience platform 120 is generally circular and is sufficiently large in diameter to prevent the audience from seeing any projection or equipment mounted below the audience platform 120, the central post 160 or any part of the bottom (lower) portion of the projection surface 170. Also, the diameter of the circular audience platform 120 should be sufficiently smaller than the surrounding projection surface 170 to allow the projected images and lights originating above the ceiling 150 or below the audience platform 120 to strike the projection surface 170 at a height substantially at the audience eyeline, and prevent members of the audience with average eyesight from noticing any seams, perforations, or imperfections in the projection surface 170. In one embodiment, the audience platform 120 is approximately 20 to 30 feet smaller in diameter than the projection surface 170. Those skilled in the art will appreciate that the audience platform 120 may have a shape other than circular.

One or more bridge structures 130 may penetrate the projection surface 170 to enable the audience to enter and exit the theater assembly 100. Two bridge structures are shown in FIG. 2. The bridge structure 130 is configured to prevent the audience from seeing any equipment mounted within the theater assembly 100 or any seams, perforations, or imperfections in the projection surface 170. This can be accomplished by enclosing the bridge structure, or alternatively, using frosted glass or similar wall structure to hide the equipment from the audience. A light lock 210 may be located at the entry of each bridge structure 130 to prevent outside light from entering the theater assembly. The light lock 210 generally consists of a series of curtains, walls or panels that substantially blocks the direct line of sight into the bridge or the theater is blocked from outside the light lock 210.

A railing 140 substantially surrounds the outer perimeter of the audience platform 120 to safely contain the audience. The railing 140 may be constructed from a variety of known materials, such as wooden or metal bars, mesh or glass panels. Preferably, the railings allow images to be viewed through them.

The ceiling 150 may be suspended from a central hanging structure 180. As shown in FIG. 2, the ceiling 150 is substantially the same size and shape as the audience platform to prevent the audience from seeing any projection or other equipment mounted above the ceiling 150.

Figure 4:
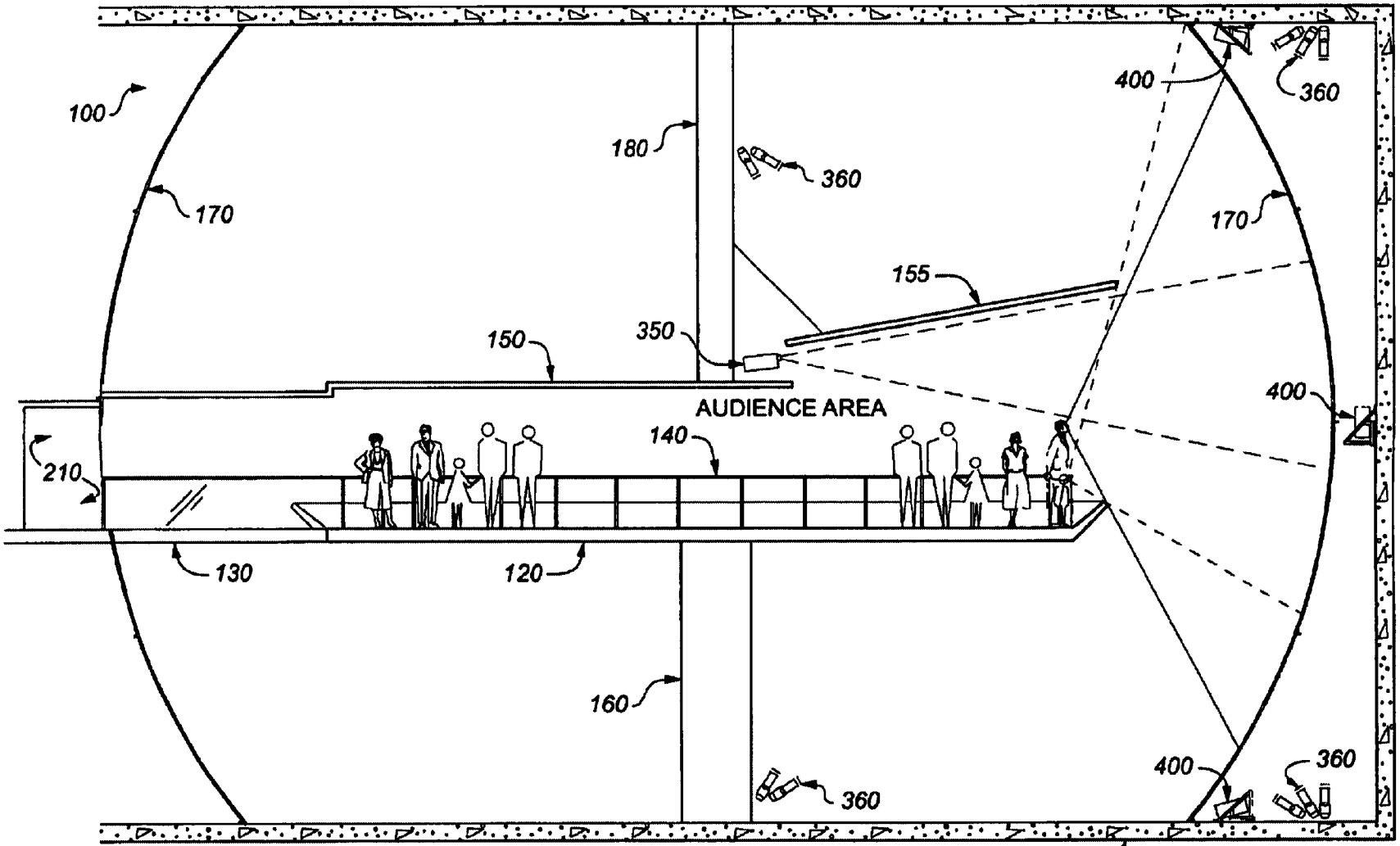
FIG. 4 is a sectional view of another embodiment of the theater assembly of the present invention with a partially movable ceiling.

In accordance with another embodiment of the present invention, as shown in FIG. 4, a portion of the ceiling 155 may be detached from the rest of the ceiling 150. The detached portion of the ceiling 155 may be lifted and angled upwardly at its perimeter edge to allow one or more projectors 350 to be positioned below the level of ceiling portion 155. When so positioned, projectors 350 may be used to project images to an area on the projection surface 170 that is substantially at or slightly above the audience eyeline. This advantageously permits the theater assembly 100 to be used as a conventional (industry-standard) film or video theater, thereby permitting the industry-standard films or videos to be shown without any modification.

A program comprising film images, video images or the like (hereinafter referred to as the projection program) may be projected onto the projection surface 170 using a projection system which may comprise a single projector 350 with or without accompanying mirrors 310, or a plurality of projectors 350 with or without accompanying mirrors 310, or the like. Although, FIG. 1 shows only one projector 350 mounted on the post 160 and one projector 350 on the hanging structure 180, it is appreciated that a plurality of projectors 350 may be mounted on the post 160 and the hanging structure 180, as shown in FIG. 2. The desired program may be generated from overlapping video images to provide a single, continuously viewable image. The overlapping video images from the projection system comprising multiple projectors 350 may be blended vertically and horizontally using a conventional soft-edged blending technique, such as that employed by the "Panoram" system. In other words, a single, continuously viewable image is created from several separately projected individual images whose overlapping edges are blended in such a manner that the edges are not visible to the audience. Preferably, the projectors 350 project a high definition video, scan-converted digital video or real-time digital animation at 1024×768 resolution or higher.

Figure 6:
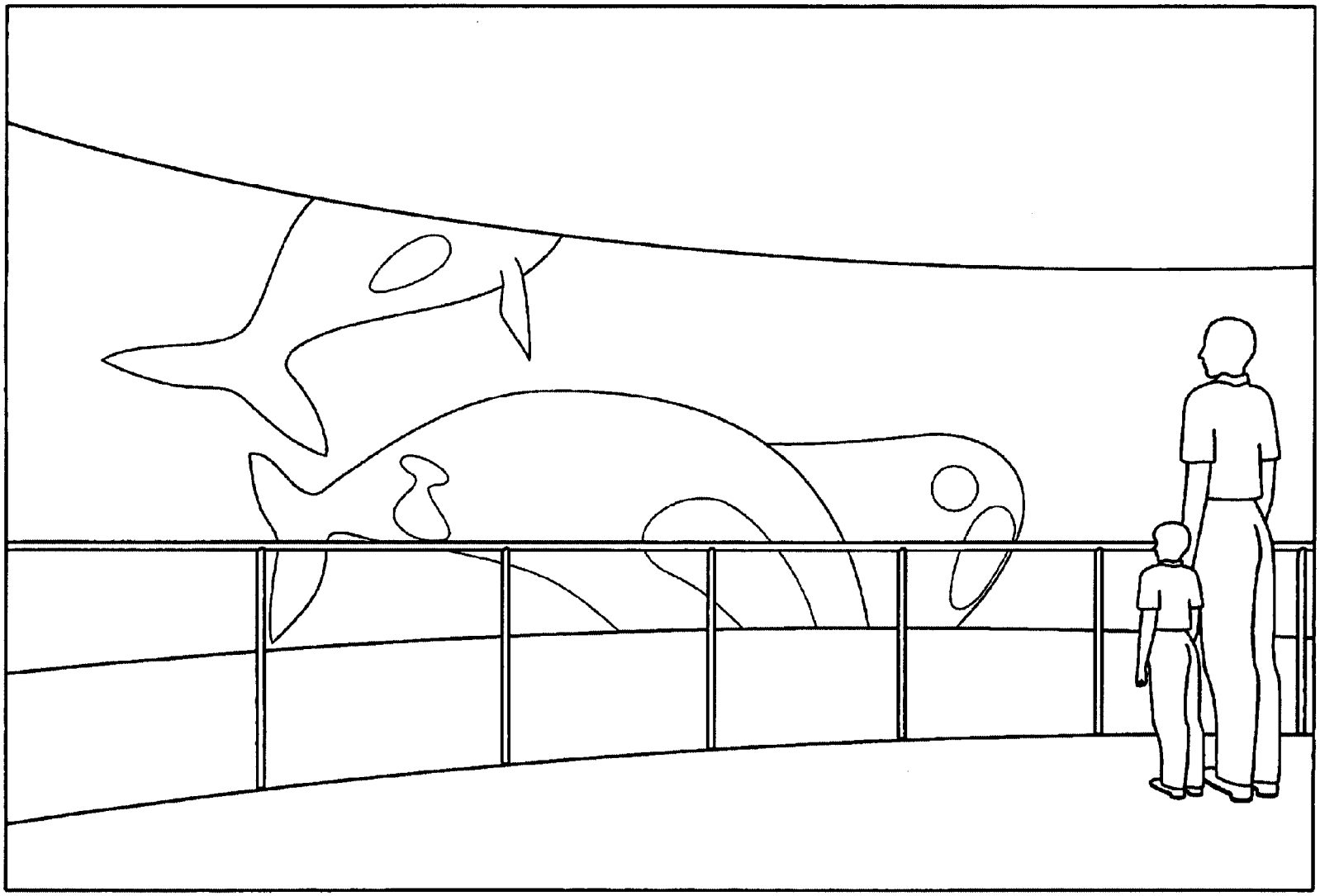
FIG. 6 is a diagram depicting the audience's perspective while standing on the audience platform of the present invention.

In accordance with another embodiment of the present invention, the mirror 310 is a computer-controlled movable mirror. That is, the mirror 310 may be moved in response to a command from a computer (not shown). The output of each projector 350 is directed onto a computer-controlled movable mirror. The images reflected from the computer-controlled movable mirror are then projected onto the projection surface 170. The projection system, comprising a plurality of projectors 350 and computer-controlled movable mirrors, may be operable to allow the individually projected images of objects or the "foreground" images, such as a whale, a fish, a spaceship or the like, to move along the projection surface 170 in any direction in coordination with the apparent movement of the object within the "background" imagery (e.g., a boundless environment such as an ocean). For example, as shown in FIG. 6, a whale swimming in an aquarium or ocean may be projected using this system. This is accomplished by projecting the image of the object, e.g., a whale, first onto a computer-controlled movable mirror, which reflects the image of the object onto the screen at a position and with a motion appropriate for the image of the object and the projection program itself. According to the present invention, the image of the object being projected onto the mirror, the foreground image, does not significantly interact with the background imagery or lighting effect. This creates a seamless imagery (a boundless environment) surrounding the audience, such as water, outer space or the like. It will be appreciated that the above-noted advantages may also be achieved by using movable projectors focused on fixed mirrors or movable projectors without mirrors. In other words, the projectors may be moved instead of the mirrors to move individual projected objects along the projection surface 170.

In addition, producing the animated foreground image using the above-noted movable projection system may be significantly less expensive than producing a complete, seamless video image which completely surrounds the audience from a conventional, stationary projection system. It would be impractical to form a seamless image from a plurality of overlapping images using a stationary projection system employing such narrower lens without movable mirrors. Also, a significantly higher resolution and brightness may be achieved using the movable projection system because the foreground image produced is smaller than a comparable projected image produced using a Panoram system or the like. Accordingly, the movable projection system advantageously permits the use of a narrower lens, i.e., a longer focal length, to produce a smaller projected image.

Projecting a small, bright foreground image onto a dimmer, less sharp background image will give the impression that the foreground image is both closer and more three-dimensional to the observer, than an image contained in a single image produced by a projection system which creates both the foreground and background images. In the present invention, background images may be generated from a plurality of overlapping video images as described hereinabove, a lighting effects device or the like.

When a projected image, such as a whale, is first reflected off of a movable mirror, the projected image must be rotated around the optical axis of the projector 350, in direct proportion to the angular motion of the movable mirror. This enables the projected image to continuously appear in a correct (or proper) orientation with respect to the background image. In other words, the motion of the mirror, in the present invention, may cause the projected image to move laterally across the audience field of view in direct proportion to the rate of angular motion of the mirror. To compensate for this rotational effect, the projected image itself must be rotated around the optical axis of the projector 350 in an opposite direction.

In theory, two mirrors may be used to compensate for this rotational effect, such that the projected (or "foreground") image appears in a correct orientation with respect to the background imagery. However, this may be impractical due to the cost associated with employing such a two-mirror system and the required size of the mirrors. It is appreciated that in a two-mirror system, the first mirror controls the vertical axis and the second mirror controls the horizontal axis.

In accordance with another embodiment of the present invention, each projector/mirror assembly may be moved in the vertical and horizontal axis. Preferably, the projection system comprises a movable projector/mirror assembly or assemblies mounted upon a gantry 330, preferably motorized and computer-controlled. For simplicity, FIG. 3 only illustrates the projector/mirror assembly moving in a vertical direction. However, the gantry 330 may also include a mechanism for moving the projector/mirror assembly vertically, radially or horizontally such that the resultant angle of the projected image from the projector/mirror assembly to the projection surface 170 is optimized for the projector optics, the geometry of the audience platform, and any objects within the theater assembly which may otherwise obstruct the projection of the image. Accordingly, the gantries 330 comprising the mirrors 310 and the projectors 350, which are focused radially toward the projection surface 170, are mounted both above the ceiling 150 and below the audience platform 120. This will permit the projector 350 to project the full image onto the projection surface 170 and beyond the obstructing audience platform 120 or ceiling 150. The optimum position for projecting an image into the audience line-of-sight may be from the point vertically furthest from the audience. Accordingly, the projectors 350 may be required to move to an extreme vertical position, i.e., the maximum distance from the audience, to project an image substantially at the audience eyeline and to a vertical position nearest to the audience to project an image at the extreme vertical limit of the audience's view.

Figure 7:
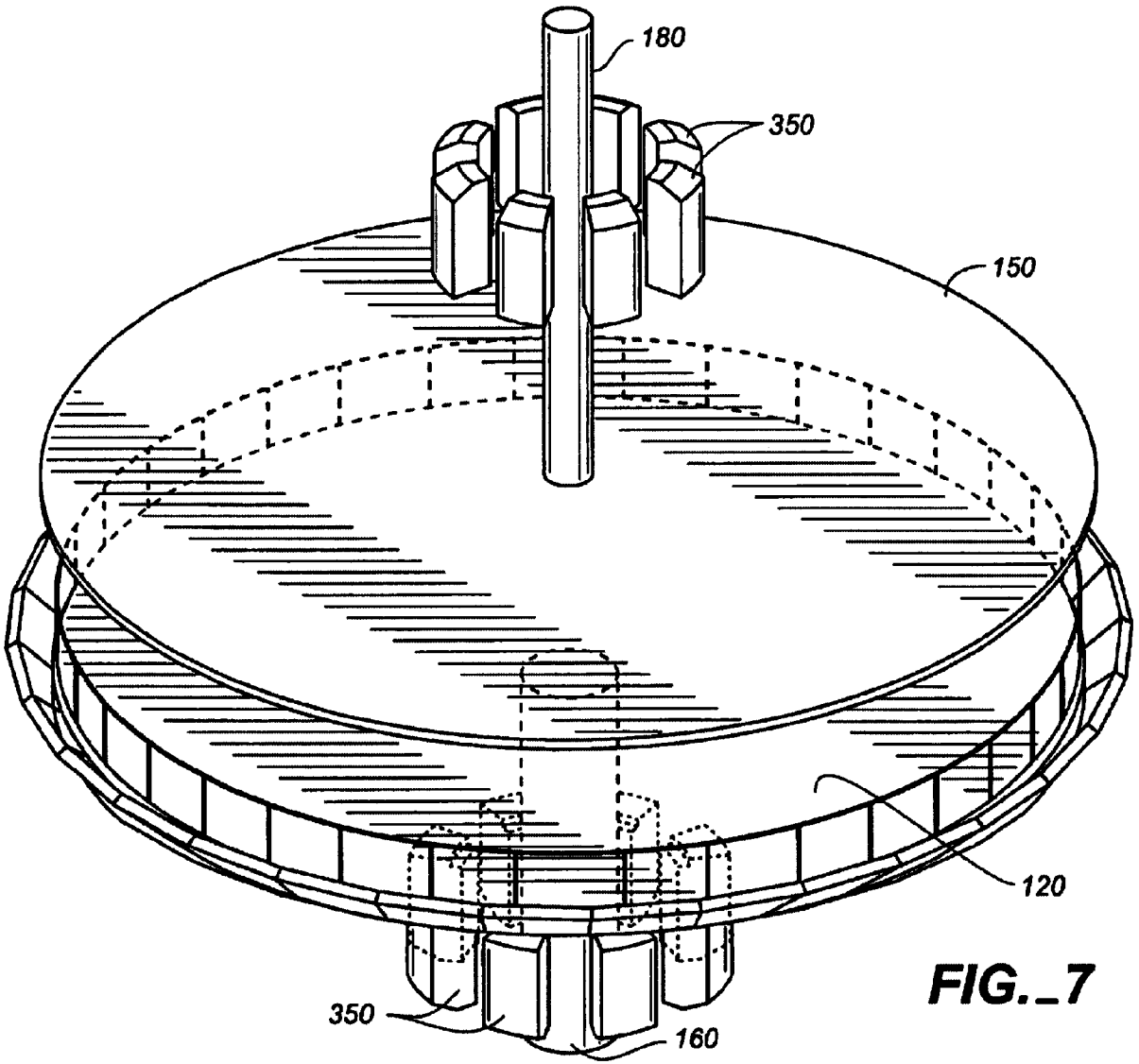
FIG. 7 is a plan view of another embodiment of the theater assembly of the present invention with rows of projectors.

In accordance with another embodiment of the present invention, the optical projection system may comprise rows of projectors 350 with or without accompanying mirrors 310, arranged vertically, to cover the areas of the projection surface 170 above the ceiling 150 and below the audience platform 120 to substantially fill the audience's vertical field of view, as shown in FIG. 7. Preferably, the total number of rows is greater than one. However, it is appreciated that the optical projection system utilizing narrower lens having longer focal length may need to be continuously refocused to project images of desired resolution.

Figure 5A:
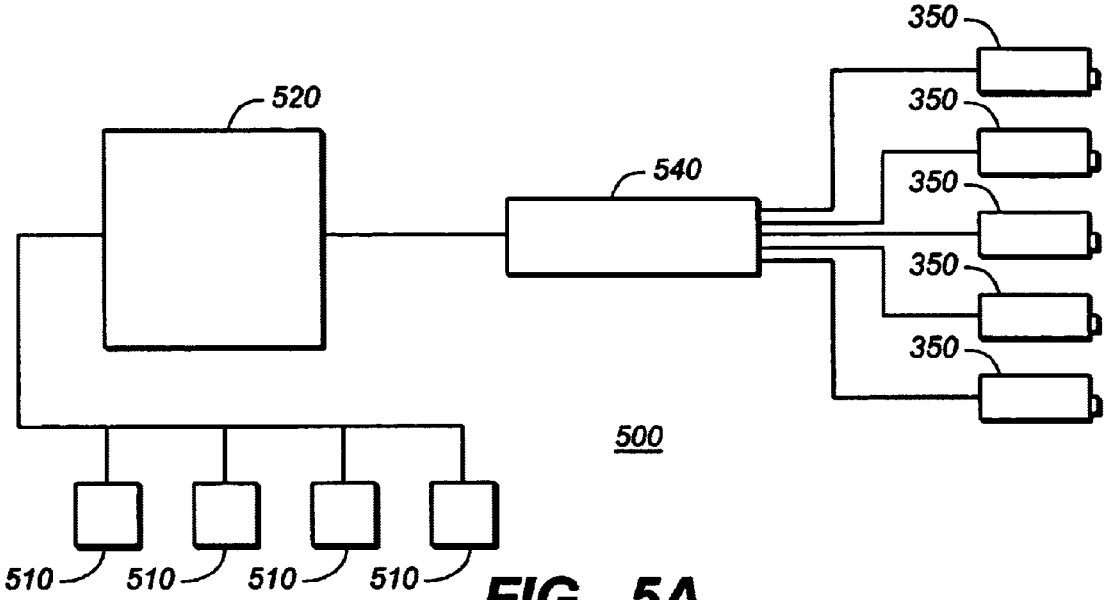
FIGS. 5A and 5B are schematic diagrams of show control system of the present invention.
Figure 5B:
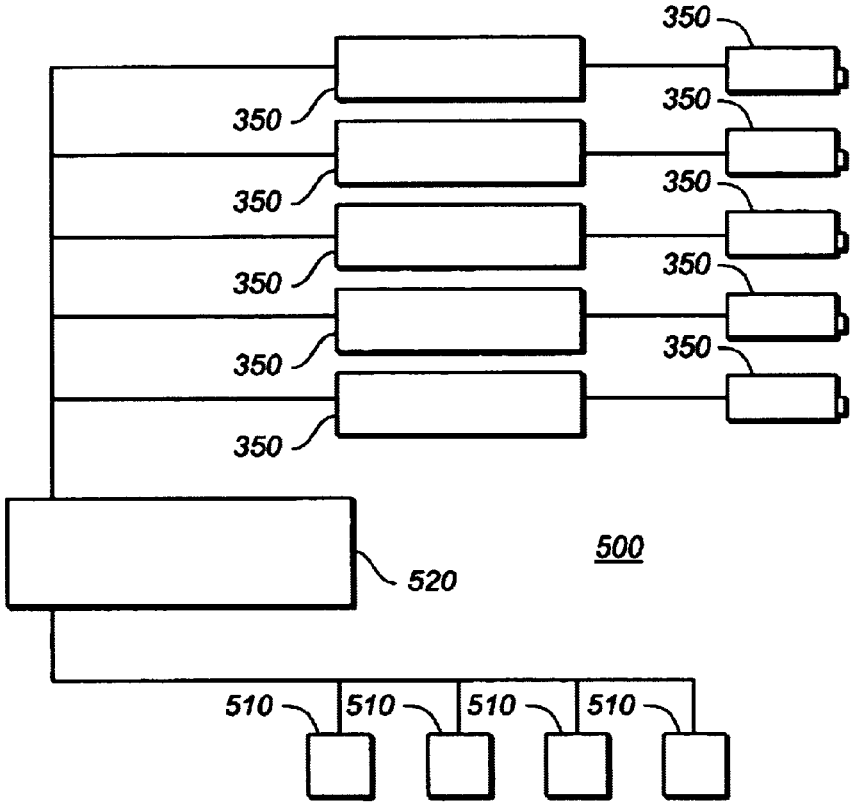

In accordance with yet another embodiment, the theater assembly 100 of the present invention further includes a computer-driven show control system 500 which controls the display of the projection program, such as starting, regulating, and stopping the projection program. Show control system 500 may be operated with or without a human operator. The show control system 500 may also be integrated with one or more computers which create real-time computer-generated or digital-video images to be projected onto the projection surface 170. Preferably, as shown in FIGS. 5A and 5B, the show control system 500 includes sensors 510 for sensing the action of an audience, such as the motion of individual members of the audience or groups of individuals within the audience, or sound produced by an individual or group of individuals within the audience. The show control system 500 may alter the display of the program in accordance with the data derived from these sensors 510, to thereby enable the audience to influence the display of subsequent images. The sensors 510 may comprise motion-sensors or beam-interrupt devices to detect general audience motion and position, and may also comprise or include microphones placed throughout the audience area to receive audience sounds. Information from sensors 510 may be fed to the show-control device 520, preferably a computer or a network of computers, for processing. The show control device 520 may then utilize the data to control the program to be played, by the projectors 350 in accordance with pre-determined parameters. For example, the playback devices 530 of FIG. 5B may contain pre-rendered images in JPEG, MPEG2 or MPEG video (moving picture expert group video) format or the like. In accordance with the processed data, the show control device 520 selects a sequence of images to project onto the projection surface 170 (FIG. 1) using one or more of the playback devices 530 to send the desired images to one or more of the projectors 350. The images are thereby selected and projected onto the projection surface 170 in response to audience motions and/or sounds. It is appreciated that the playback device 530 may represent a DVD player, a multistream digital player, a VCR, a video disk player, a computer or the like.

The show control device 520 of FIG. 5A may additionally include a playback device 530. The sequence of images to be projected is then selected and transmitted to a signal processor 540, which routes the selected images to an appropriate projector 350 for projection onto the projection surface 170. Alternatively, the show control device 520 of FIG. 5A may include an imaging computer or a plurality of networked imaging computers for generating images in real time. The show control device 520 affects the generation of computer-generated images in accordance with the translated data. In other words, the images are generated and projected onto the projection surface 170 in response to either audience motions or sounds.

Figure 3:
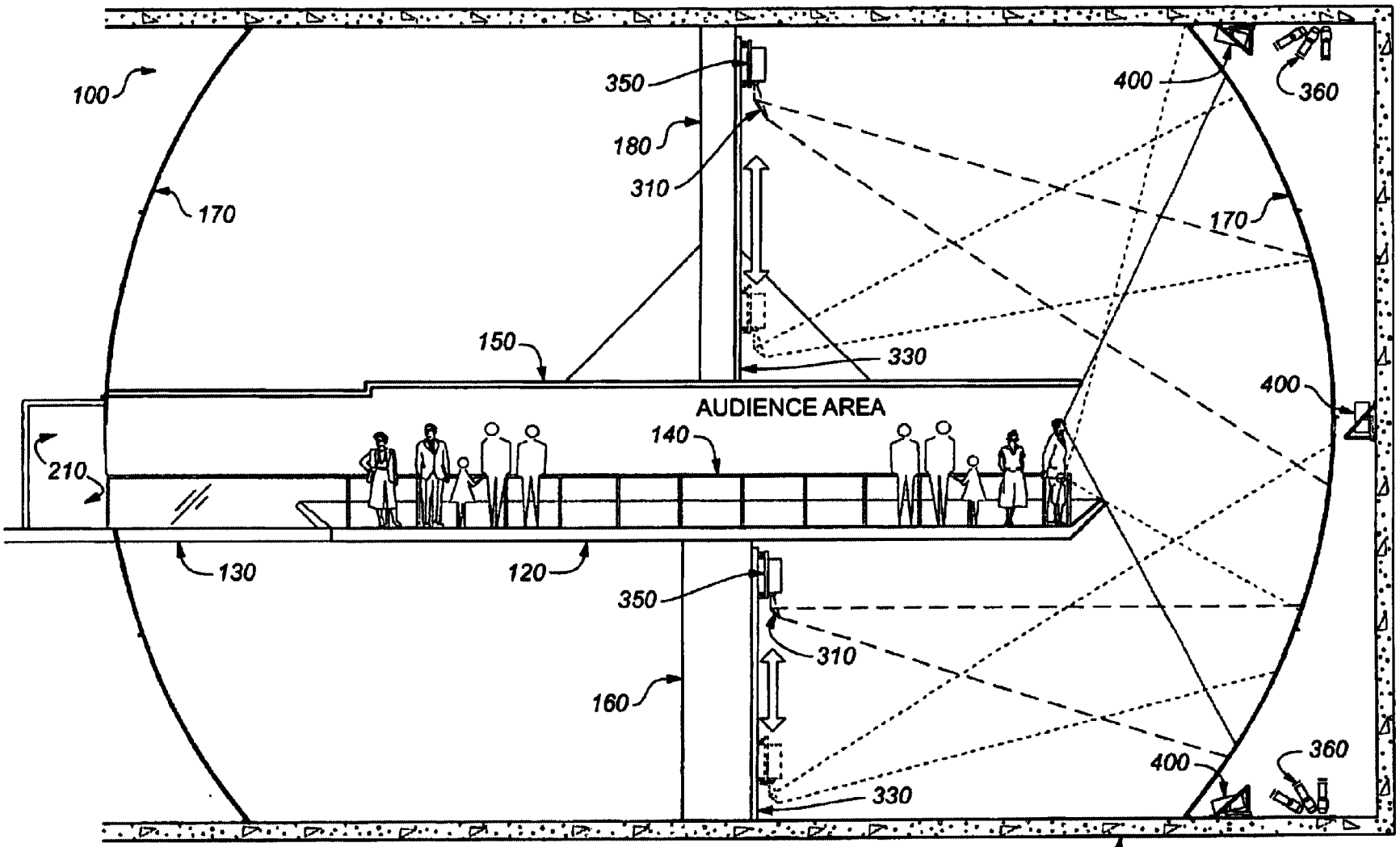
FIG. 3 is a sectional view of another embodiment of the theater assembly of the present invention.

Returning to FIG. 4, the theater assembly 100 of the present invention may additionally include one or more special effects device 360 for controlling the lighting, atmosphere and sound within the theater assembly 100. Preferably, the special effects devices 360 operate under the control of the show control system 500 (FIGS. 5A and 5B). Although not shown, the special effects device 360 may comprise light sources recessed in the ceiling 150 and/or audience platform 120 to light the audience area. The special effects device 360 may be located either behind the projection surface 170, above the ceiling 150, or below the audience platform 120. It is appreciated that the show control system 500 may control the special effects device 360 in conjunction with the projection program to be displayed onto the projection surface 170. For example, individual light sources or combinations of light sources may be brightened or dimmed to create an illusion that objects, such as fishes, marine mammals, space ships, or the like, are passing above or below the audiences, create shadows, or the like. Preferably, the special effects device 360 may further include projectors to create theatrical or lighting effects. These projectors may be focused on the projection surface 170 to augment the images projected from the projectors 350. Since the projection surface 170 is preferably perforated, the theatrical or lighting effects may be additionally enhanced by positioning additional rear- and/or front-projectors outside the projection surface 170, as shown in FIGS. 3 and 4.

The special effects device 360 may additionally include a device to produce a desired atmospheric effect, such as a mist or water vapor fog, in conjunction with the projection program.

Special effects devices 360 may also include a multichannel sound system 400 consisting of amplification equipment, audio distribution equipment, and speakers. The sound system 400 produces sound effects in multiple directions, and is preferably mounted within the theater assembly in such a manner that none of the sound system components are visible to the audience. The speakers may be mounted above the ceiling 150, below the audience platform 120, or outside the projection surface 170. The sound system 400 may be configured to create effects which imply vertical, rotational, or horizontal motion on the part of the audience or of objects projected onto or behind the projection surface 170. For instance, a whale may be projected to move laterally across the audience view, then to appear to swim upward and over the ceiling, then down across the other side and directly away. By "panning" the whale sound through different channels and speakers placed behind the screen surface and above the audience ceiling, the sound may be made to appear to follow the image of the whale as it moves. In addition, the sound system 400 may be configured to produce low-frequency effects, comprised of a single frequency or plurality of harmonic frequencies, which produce physical sensations such as an increase or decrease in atmospheric pressure.

While the present invention has been particularly described with respect to the illustrated embodiment, it will be appreciated that various alterations, modifications and adaptations may be made based on the present disclosure, and are intended to be within the scope of the present invention. It is intended that the appended claims be interpreted as including the embodiment discussed above, those various alternatives which have been described and all equivalents thereto.

What is claimed:

1. A theater for providing an audience with a virtual reality immersion experience comprising:

a projection screen disposed about a vertical central axis which passes through an elevated horizontal platform, said screen substantially surrounding said platform and extending above and below said platform;

a ceiling structure;

a sound system; and a projection system for creating a continuous image on said projection screen;

wherein said platform and said ceiling structure are positioned such that the top and bottom edges of said projection screen are not visible to the audience from any position on said platform.

2. The theater of claim 1, wherein said ceiling structure is positioned above said platform such that the audience is prevented from viewing the uppermost portion of said projection screen and wherein said platform is shaped such that the audience is prevented from viewing the lowermost portion of said projection screen.

3. The theater of claim 2, wherein said projection system comprises a plurality of projectors, said projectors being hidden from the audience by said ceiling structure and said platform.

4. The theater of claim 1, wherein said projection screen is cylindrical to form a cylindrical cavity.

5. The theater of claim 1, wherein said projection screen is bounded by compound-curved coves.

6. A theater for providing an audience with a virtual reality immersion experience comprising:

a projection screen disposed about a vertical central axis which passes through an elevated horizontal platform, said screen substantially surrounding said platform and extending above and below said platform;

a ceiling structure;

a sound system;

a projection system for creating a continuous image on said projection screen;

a sensing system for sensing audience actions; and a control system for controlling the images or sounds created in response to said audience actions.

7. The theater of claim 6, further comprising a lighting effects device for controlling the lighting within the theater, said lighting effects device being operable by said control system in response to said audience actions.

8. The theater of claim 6, further comprising an atmospheric effects device for controlling the atmosphere within the theater, said atmospheric effects device being operable by said control system in response to said audience actions.

9. The theater of claim 6, wherein said projection system includes a computer to generate said continuous image comprising video images, said computer being operable by said control system to generate said video images in response to said audience actions.

10. The theater of claim 6, wherein said projection system includes a plurality of playback devices for providing said continuous image comprising a sequence of pre-rendered video images.

11. The theater of claim 10, wherein said control system selects a sequence of video images by activating at least one of said plurality of said playback devices in response to said audience actions.

12. The theater of claim 6, further comprising a plurality of special effects devices located within the theater and behind said projection screen for controlling the lighting, atmosphere and sound within the theater, said plurality of special effects device being controlled by said control device in conjunction with said continuous image.

13. The theater of claim 12, wherein said projection screen is perforated to permit transmission of sound from said sound system and special effects from said special effects devices positioned behind said projection surface.

14. A theater for providing an audience with a virtual reality immersion experience comprising:

a projection screen disposed about a vertical central axis which passes through an elevated horizontal platform, said screen substantially surrounding said platform and extending above and below said platform, wherein said platform includes a plurality of bridge structures which pass through said projection screen;

a ceiling structure;

a sound system; and a projection system for creating a continuous image on said projection screen.

15. A theater for providing an audience with a virtual reality immersion experience comprising:

a projection screen disposed about a vertical central axis which passes through an elevated horizontal platform, said screen substantially surrounding said platform and extending above and below said platform;

a ceiling structure positioned above said platform such that the audience is prevented from viewing the uppermost portion of said projection screen;

a sound system; and a projection system for creating a continuous image on said projection screen, wherein said projection system comprises a plurality of projectors, said projectors being hidden from the audience by said ceiling structure and said platform; wherein a portion of said ceiling structure is detachable to permit one or more projectors to project a program at or slightly above the audience eyeline, thereby enabling the theater to be used as a conventional film or video theater.

16. A theater for providing an audience with a virtual reality immersion experience comprising:

a projection screen disposed about a vertical central axis which passes through an elevated horizontal platform, said screen substantially surrounding said platform and extending above and below said platform;

a ceiling structure positioned above said platform such that the audience is prevented from viewing the uppermost portion of said projection screen;

a sound system; and a projection system for creating a continuous image on said projection screen, wherein said projection system comprises a plurality of projectors, said projectors being hidden from the audience by said ceiling structure and said platform; wherein said projection system further comprises a plurality of mirrors, said mirrors being hidden from the audience by said ceiling structure and said platform.

17. The theater of claim 16, wherein said plurality of mirrors are movable to permit individual projected objects to move along said projection screen in any direction in coordination with the apparent movement of the object within said continuous image.

18. A theater for providing an audience with a virtual reality immersion experience comprising:

a projection screen disposed about a vertical central axis which passes through an elevated horizontal platform, said screen substantially surrounding said platform and extending above and below said platform;

a ceiling structure;

a sound system; and a projection system for creating a continuous image on said projection screen, wherein said projection system comprises a plurality of projector/mirror assemblies, each mounted upon a movable gantry.

19. The theater of claim 11, wherein each movable gantry is motorized and operable by said control system and further includes a device for moving an assembly vertically, radially or horizontally.

20. A theater for providing an audience with a virtual reality immersion experience comprising:

a projection screen disposed about a vertical central axis which passes through an elevated horizontal platform, said screen substantially surrounding said platform and extending above and below said platform;

a ceiling structure;

a sound system; and a projection system for creating a continuous image on said projection screen, wherein said projection system comprises rows of projectors and mirrors arranged vertically to fill the audience's vertical field of view, said projectors and mirrors being hidden from the audience by said ceiling structure and said platform.

21. An interactive theater for creating a perception on the part of the audience that they are immersed in a boundless environment, comprising:

a projection screen disposed about a vertical central axis which passes through an elevated horizontal platform, said screen substantially surrounding said platform and extending above and below said platform;

a ceiling structure;

a sound system;

a projection system for creating a continuous image on said projection screen;

a sensing system for sensing audience actions; and a control system for controlling the images or sounds created in response to said audience actions.

22. The theater of claim 21, further comprising a lighting effects device for controlling the lighting within the theater, said lighting effects device being operable by said control system in response to said audience actions.

23. The theater of claim 21, further comprising an atmospheric effects device for controlling the atmosphere within the theater, said atmospheric effects device being operable by said control system in response to said audience actions.

* * * * *